US010858868B2

(12) United States Patent
Gotzen et al.

(10) Patent No.: US 10,858,868 B2
(45) Date of Patent: Dec. 8, 2020

(54) MOTOR VEHICLE DOOR LOCK

(71) Applicant: Kiekert Aktiengesellschaft, Heiligenhaus (DE)

(72) Inventors: Klaus Gotzen, Mulheim (DE); Carsten Fuchs, Dusseldorf (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 1083 days.

(21) Appl. No.: 14/654,630

(22) PCT Filed: Dec. 18, 2013

(86) PCT No.: PCT/DE2013/000801
§ 371 (c)(1),
(2) Date: Jul. 20, 2015

(87) PCT Pub. No.: WO2014/094714
PCT Pub. Date: Jun. 26, 2014

(65) Prior Publication Data

US 2015/0315824 A1 Nov. 5, 2015

(30) Foreign Application Priority Data

Dec. 21, 2012 (DE) ..... 10 2012 025 403

(51) Int. Cl.
*E05B 77/06* (2014.01)
*E05B 79/10* (2014.01)
(Continued)

(52) U.S. Cl.
CPC ..... *E05B 85/26* (2013.01); *E05B 77/06* (2013.01); *E05B 79/10* (2013.01); *E05B 85/243* (2013.01); *Y10T 292/108* (2015.04)

(58) Field of Classification Search
CPC ..... E05B 85/26; E05B 79/10; E05B 85/243; E05B 77/06; E05B 77/04; E05B 77/12; E05B 77/54; Y10T 292/108
See application file for complete search history.

(56) References Cited

U.S. PATENT DOCUMENTS 5,865,481 A * 2/1999 Buschmann ..... E05B 77/06 292/169.11
8,480,138 B2 * 7/2013 Bendel ..... E05B 85/26 292/201
(Continued)

FOREIGN PATENT DOCUMENTS

DE 19811851 A1 10/1995
DE 198 24 640 C1 1/1998
(Continued)

OTHER PUBLICATIONS

Machine Translation of EP1241305B1 by Lexis Nexis Total Patent on Jul. 16, 2015.
(Continued)

*Primary Examiner* — Kristina R Fulton
*Assistant Examiner* — Thomas L Neubauer
(74) *Attorney, Agent, or Firm* — Woodard, Emhardt, Henry, Reeves & Wagner, LLP

(57) ABSTRACT

The invention relates to a motor vehicle door lock, which is equipped with a ratchet mechanism, at least one actuation lever for triggering the ratchet mechanism and a ratchet lever that is pivotable about an axis. The ratchet lever renders the ratchet mechanism ineffective, at least with regard to the magnitude and direction of occurring retarding forces, for example in the event of an accident ("in the event of a crash"). According to the invention the ratchet lever is mounted eccentrically on the axis thereof and thereby pro-
(Continued)

duces in dependence of the occurring retarding forces a counter-torque that blocks the actuation lever.

18 Claims, 3 Drawing Sheets

(51) Int. Cl.
*E05B 85/24* (2014.01)
*E05B 85/26* (2014.01)

(56) References Cited

U.S. PATENT DOCUMENTS

| | | | | |
|---|---|---|---|---|
| 8,955,889 | B2 * | 2/2015 | Bendel | E05B 81/20 292/200 |
| 9,580,938 | B2 | 2/2017 | Bendel | |
| 9,879,450 | B2 * | 1/2018 | Wahmann | E05B 77/54 |
| 9,920,555 | B2 * | 3/2018 | Brickner | E05B 77/12 |

FOREIGN PATENT DOCUMENTS

| | | | |
|---|---|---|---|
| DE | 197 38 492 | A1 | 3/1998 |
| DE | 198 03 871 | A1 | 8/1999 |
| DE | 103 46 104 | A1 | 4/2005 |
| DE | 10 2011 010 797 | A1 | 8/2012 |
| EP | 1241305 | B1 | 9/2002 |
| WO | WO 2012013182 | A2 | 2/2012 |
| WO | WO 2012107023 | A2 | 8/2012 |

OTHER PUBLICATIONS

Machine Translation of WO2012013182A2 by Lexis Nexis Total Patent on Jul. 16, 2015.
Machine Translation of WO2012107023A2 by Lexis Nexis Total Patent on Jul. 16, 2015.
German Office Action Issued in related DE 10 2012 025 403.2 dated Sep. 17, 2013 (pp. 4).
Machine translation of DE 103 45 104 A1 by European Patent Office Patent Translate on Mar. 7, 2019 (pp. 16).
Machine translation of DE 195 11 651 A1 by European Patent Office Patent Translate on Mar. 7, 2019 (pp. 9).
Machine translation of DE 197 38 492 A1 by European Patent Office Patent Translate on Mar. 7, 2019 (pp. 22).
Machine translation of DE 198 03 871 A1 by European Patent Office Patent Translate on Mar. 7, 2019 (pp. 16).

* cited by examiner

MOTOR VEHICLE DOOR LOCK

CROSS-REFERENCE TO RELATED APPLICATIONS

This application is the U.S. national stage application of International Patent Application No. PCT/DE2013/000801, filed Dec. 18, 2013, which claims priority of German Application No. 10 2012 025 403.2, filed Dec. 21, 2012, which are both hereby incorporated by reference.

BACKGROUND

The invention relates to a motor vehicle door latch, equipped with a locking mechanism, as well as at least one actuation lever for triggering the locking mechanisms and a ratchet lever pivotable around an axis, rendering the locking mechanism ineffective at least with regard to the magnitude and direction of retarding forces occurring for example in the event of a crash.

As usual, the locking mechanism typically comprises a catch and a pawl. When retarding forces of a given magnitude and direction, are exerted in the event of a crash, there is generally the danger that the locking mechanism is opened unintentionally, as a result of the retarding forces acting on the actuation lever for triggering the locking mechanism. Such unintentional opening, in particular in the event of an accident, is prevented by the ratchet lever, rendering the locking mechanism ineffective in the event of respective retarding forces of a given magnitude and direction. Said retarding forces or the associated vehicle accelerations act in most cases in transverse (i.e. Y) direction of the motor vehicle and mainly occur in the event of a side impact.

The generic state of the art of EP 1 241 305 B1 of the applicant discloses that the ratchet lever contains a stop recess. The stop recess positively engages in an opening of the counter blocking surface in case of a blockage when the pawl or actuation lever is acted upon. In this way, the desired blocking of the actuation lever or of the locking mechanism is ensured under all possible circumstances and is, in particular, maintained during the entire time during which said retarding forces occur. This has proven to be successful.

The further generic teaching of WO 2012/013182 A2 discloses that a blocking means is assigned to the ratchet lever, fixing the ratchet lever in its deflected position. The ratchet lever only assumes this deflected position when the motor vehicle door latch is subjected to acceleration forces or retarding forces of the given magnitude and direction such as experienced, for instance, in a crash.

According to the teaching of WO 2012/013182 A2, the ratchet lever is in this case mechanically deflected and ensures that the at least one actuation lever or the entire actuation lever mechanism is mechanically ineffective or rendered ineffective. As a result, a simple and functioning design was provided and any malfunctioning can practically be prevented even after years or decades of use. This is achieved as during normal operation, the ratchet lever caries out a relative movement if the actuation lever mechanism or the actuation lever is acted upon so that the mobility of the ratchet lever as a whole is ensured and corrosion and sticking, etc. is prevented. This has proven to be successful.

In practical application, when relying on such ratchet levers and in the event of a crash, the phenomenon can occur that the actuation lever tends to "bounce". This means that the actuation lever is initially blocked by the ratchet lever during the accident and then bounces off the ratchet lever or distances itself slightly from the ratchet lever, to then move back against the ratchet lever as a result of the still applied retarding forces. This could potentially result in an unwanted opening during a crash. This must, however, be prevented at all cost so that the locking mechanism and thus the motor vehicle door remain closed and the safety devices contained in a side door can become fully effective. This is the task of the invention.

SUMMARY

The invention is based on the technical problem of further developing such a motor vehicle door latch in such a way that unintentional opening of the locking mechanism can be reliably prevented, also and, in particular during a crash. In particular the aforementioned "bouncing" of the actuation levers in relation to the ratchet lever should be prevented.

In order to solve this technical problem, a generic motor vehicle door latch according to the invention is characterized by the ratchet lever being eccentrically mounted on the or its axis, resulting in a counter-torque being generated that blocks the actuation lever, depending on the experienced retarding forces.

According to an advantageous embodiment, the ratchet lever contains, for this purpose, a centre of gravity located above or below its axis, which depending on the arising retarding forces (and its direction) generates the counter-torque on the ratchet lever blocking the actuation lever. The eccentric arrangement of the centre of gravity in relation to the axis for the ratchet lever ensures that a turning moment around the axis is generated in the event of any retarding forces occurring on the ratchet lever. As a whole, this turning moment is designed as a counter-torque in comparison to a rotary moment of the actuation lever (in the opening sense or in the event of a crash). The counter-torque on the ratchet lever and that of the actuation lever in the event of a crash is also in the opposite direction.

This means that the ratchet lever typically contains a stop that moves against the actuation lever in the event of a crash in order to block it. As the ratchet lever also has said counter-torque in relation to its axis as a result of the occurring retarding forces, this counter-torque acts against the direction of the actuation levers into which it moves in the event of a crash. This counteracts the aforementioned "bouncing" of the actuation levers. As soon as the actuation lever leaves its position at the stop of the ratchet lever during such bouncing, the centre-torque applied to the blocking lever ensures that the ratchet lever can follow the actuation lever briefly lifting off the stop.

This counteracts the described "bouncing". The actuation lever consequently constantly rests against the ratchet lever or the stop so that any unintentional opening of the locking mechanism during the entire crash event can be reliably prevented, even in case of a bouncing of the actuation lever. These are the main advantages of the invention.

According to a further embodiment of the invention it has proven to be advantageous for the centre of gravity in axial elongation being arranged above or below the axis of the ratchet lever. Generally, the invention favors the centre of gravity in axial direction to be arranged above the axis of the ratchet lever, although this not essential. The important fact is that the said counter-torque is generated due to the eccentric position of the ratchet lever in the event of a crash. Such a counter-torque is always feasible and can be generated when the centre of gravity of the ratchet lever—as in the invention—does not coincide with the axis of the ratchet lever, around which it is rotatably mounted. This is achieved by the eccentric mounting provided as part of the invention.

According to a further advantageous embodiment with particular significance, the ratchet lever contains a connected spring. This spring is generally designed as a leg spring and is connected to the ratchet lever by one leg. The other leg or generally the spring is acted upon by the actuation lever during normal operation in order to deflect the ratchet lever. In this way the invention ensures that during normal operation—when no increased retarding forces resulting from a crash are applied—the ratchet lever is also moved with every deflection of the actuation lever. This procedure ensures that any corrosion of the ratchet lever in relation to its bearing mandrel defining the axis is reliably counteracted. In the event of a crash, the respective spring is compressed, as the ratchet lever more or less maintains its position due to the applied inertia forces and the actuation lever is pivoted around its axis until it reaches the stop on the ratchet lever and is blocked. Blocking of the actuation lever ensures that the locking mechanism is not unintentionally opened.

The ratchet lever generally also contains a guide recess for a guide arm on the actuation lever to engage therein. The guide arm can contain a journal acting on the spring which for this purpose normally extends through the guide recess. This design ensures that, during normal operation, the ratchet lever reliably follows and can also follow the associated pivoting movements of the actuation lever around its axis. Such a pivoting movement of the actuation lever actually corresponds to the guide arm, engaging in the guide recess or the journal of the guide arm acting on the spring, resulting in the thus pivoted actuation lever moving along the ratchet lever as desired. Only in the event of a crash or in case of (increased) retarding forces of the specified magnitude, is the ratchet lever not carried along but basically remains in the resting position due to the applied inertia forces. The pivoted actuation lever compresses the spring until reaching the stop at the ratchet lever and until it is blocked. As a result, the actuation lever can (no longer) open the locking mechanism.

The ratchet lever is actually a rectangular lever, eccentrically mounted on the axis. The rectangular lever can, where necessary, be extended and can contain side walls in order to provide in this manner a protected area below the rectangular lever, for accommodating the spring as well as the journal on the guide arm, interacting with the spring.

The described shift in the centre of gravity typically in an axial elongation of the axis above or below said axis, is generally achieved by the ratchet lever containing an extension in axial elongation in the direction of the locking mechanism. As a result, the centre of gravity moves into a position in axial elongation above the axis of the ratchet lever. This is naturally only an example and not mandatory.

The actuation lever is typically an actuation lever for a pawl as part of the locking mechanism. The locking mechanism comprises, as usual, a catch and said pawl engaging in the closed state of the locking mechanism in a main ratchet of the catch. During normal operation, the actuation lever or triggering lever for opening the locking mechanism engages with a stop on the pawl, so that it is pivoted away by the catch. As a result, the catch can open with the aid of a spring and release a previously retained locking bolt. In the event of a crash, the ratchet lever ensures that the triggering or actuation lever is blocked and that the pawl cannot be lifted off the catch.

Lastly, the ratchet lever can also be assigned to a stop in the housing. This stop regularly ensures that when retarding forces are exerted, the ratchet lever is blocked in the opposite direction. Such retarding forces in the opposite direction can, for instance, occur in case of a side impact on the side opposite the viewed vehicle side. The stop is arranged in such a way that the ratchet lever can easily carry out the described pivoting movement around the axis when in standard operation.

As a result, a motor vehicle door latch is provided, offering the advantage of particular reliability. The invention actually ensures that any "bouncing" occurring in the event of a crash between the actuation lever or the actuation lever and the ratchet lever is controlled and does not cause unintentional opening of the locking mechanism during an accident. This is mainly due to the fact that according to the invention the ratchet lever is eccentrically mounted on its axis. As a result, the ratchet lever generates a counter-torque, blocking the actuation lever in the event of a crash, absorbing any bouncing, as described. These are the main advantages.

Below, the invention is explained in detail with reference to a drawing showing only one embodiment, in which:

DETAILED DESCRIPTION OF THE DRAWINGS

Figure 1B:
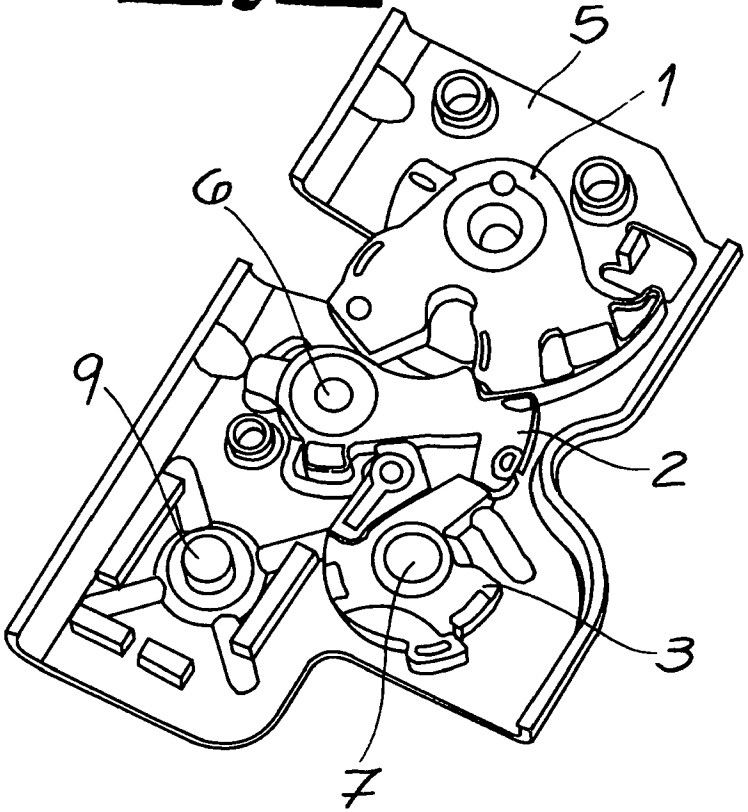
FIGS. 1A and 1B show the motor vehicle door latch of the invention in an installed state (FIG. 1A) and with the ratchet lever and actuation lever removed (FIG. 1B)
Figure 1A:
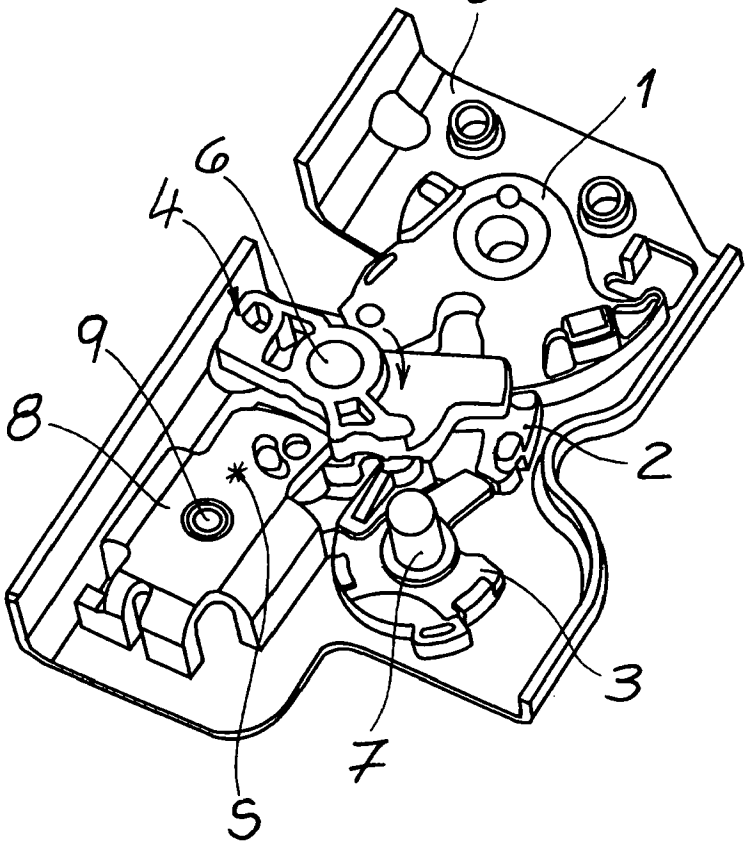

The figures show a motor vehicle door latch containing a locking mechanism 1, 2, 3 as usual. The locking mechanism 1, 2, 3 consists of a catch 1 and, in the embodiment, two pawls 2, 3. The pawl 3 carries out the actual function whilst pawl 2 is designed as a so-called comfort pawl. Pawl 3 is a blocking lever that blocks pawl 2 against catch 1 as shown in FIGS. 1A and 1B. This is, however, not important in this case as the details associated with this special embodiment are not explained further.

A decisive fact is that the locking mechanism 1, 2, 3 shown, for instance, in FIGS. 1A and 1B in the main ratchet position, can be opened by the pawl 2, 3 being lifted off the catch 1. As a result, a locking bolt—not expressly shown—previously retained by the catch 1 is released so that the associated motor vehicle door can be opened. An actuation lever 4 is provided to lift the pawl 2, 3 off the catch 1 or to trigger the locking mechanism 1, 2, 3 which in the example is a triggering lever 4, although the invention is not restricted to this.

It is apparent that the actuation lever or the triggering lever 4 and the pawl 2, 3 or its comfort pawl 2 are mounted on the same axis in a frame box 5. For this purpose, a bearing mandrel 6 is provided, defining said common axis.

During normal operation and for triggering the locking mechanism 1, 2, 3 the actuation lever or the triggering lever 4 is pivoted, as shown in FIGS. 1A and 1B, in clockwise direction around the bearing mandrel 6 or the axis defined thereby. This is apparent from the transition between FIG. 1A, 1B to FIG. 2. As a result of the clockwise movement of the actuation levers or triggering lever 4, the pawl 2, 3 is lifted off the catch 1. During this process, the comfort pawl 2 also actually carries out a clockwise movement around the common axis 6 with the triggering lever 4. In contrast, the pawl 3 (blocking lever) is pivoted around its axis 7 in counter-clockwise direction so that the pawl 2 releases the catch 1 as apparent from the transition between FIG. 1A, 1B and FIG. 2. Normal operation corresponds to this.

Figure 3:
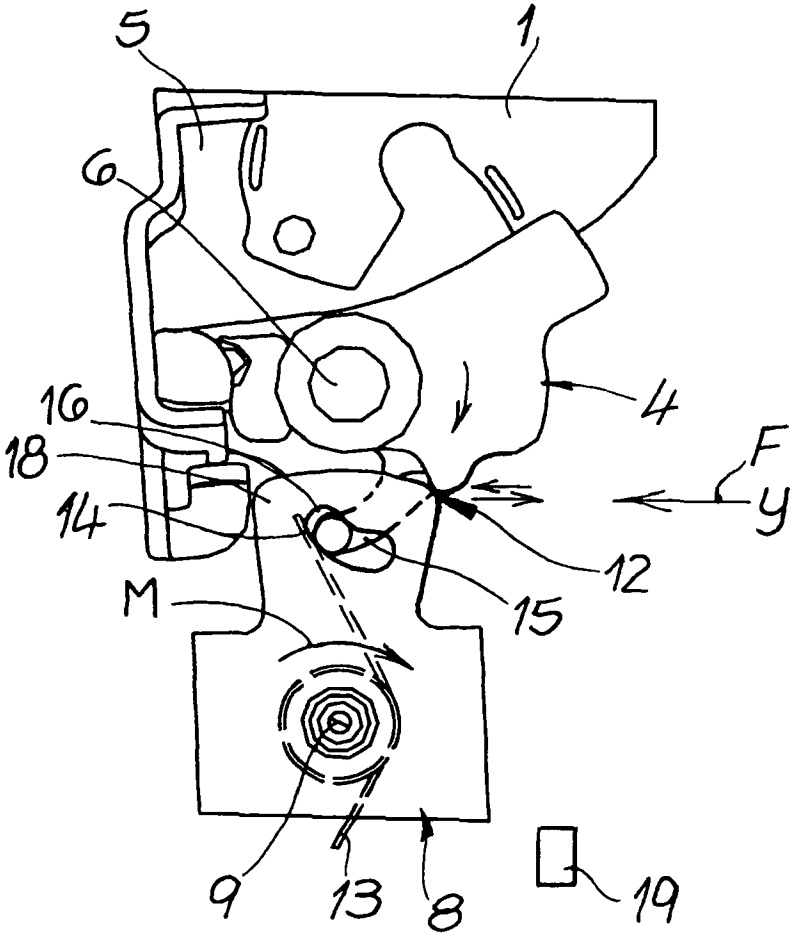

The further basic arrangement of the shown motor vehicle door latch also includes a ratchet lever 8, pivotably mounted around an axis 9 in the frame box 5. The axis 9 is defined by an associated bearing mandrel for the ratchet lever 8. The ratchet lever 8 ensures that the locking mechanism 2, 3 is rendered ineffective at least in the event of retarding forces F of a given magnitude and direction occurring, for instance in case of a crash. The respective retarding forces F are indicated in FIG. 3 by a respective arrow and correspond to the shown motor vehicle door latch, designed as a side door latch being subjected to a side impact on the associated side door. Such a side impact and the associated retarding forces F are predominantly exerted on the motor vehicle in Y- or transverse direction.

As part of the invention, the ratchet lever 8 is eccentrically mounted on the axis 9. As a result, the ratchet lever 8 generates a counter-torque M, blocking the actuation lever or triggering lever 4 depending on the occurring retarding forces F, as schematically shown in FIG. 3. This counter-torque M acts on the ratchet lever 8 in clockwise direction in relation to its axis 9. In the event of a crash, the actuation lever or the triggering lever 4 also moves in clockwise direction around its axis 6, as indicated by respective arrows in FIG. 3. As a result, opposing movements are carried out in a contact area between the ratchet lever 8 and the actuation lever 4, as shown in FIG. 3.

As soon as the actuation lever 4 leaves or threatens to leave a stop 12 on the ratchet lever 8 as a result of the already discussed "bouncing movement", the stop 12 or the ratchet lever 8 can follow the actuation lever 4 as a result of the counter-torque M generated in the event of a crash. Consequently, the aforementioned "bouncing" does not occur. Instead, the invention ensures that, in the event of a crash, the actuation lever 4 permanently rests against the stop 12 of the ratchet lever 8 and is blocked in this way.

As in the event of a crash or due to the occurring retarding forces F of a given magnitude and direction, the ratchet lever 8 maintains its position due to the intrinsic inertia, the actuation lever or triggering lever 4 cannot open the locking mechanism 1, 2, 3 in this case.

In order to achieve this in detail, the ratchet lever 8 contains a centre of gravity S, located above its axis 9 in the example embodiment. This is indicated in FIG. 1A. The centre of gravity S is actually located in the axial elongation above the respective axis 9 of the ratchet lever 8. Generally, also another arrangement of the centre of gravity S, is feasible, as for instance below axis 9. This is, however not shown.

Figure 2:
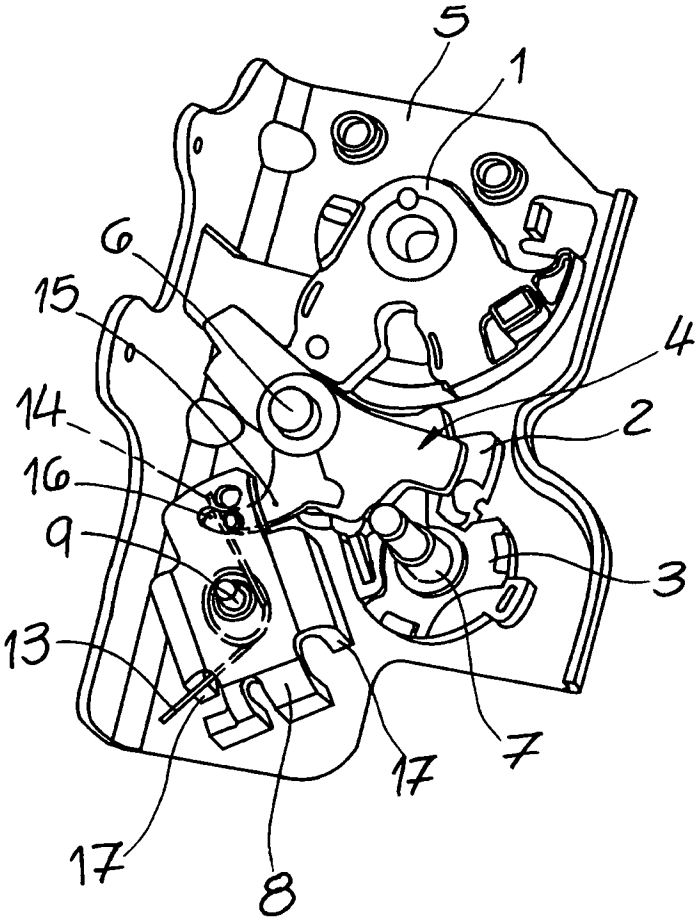
FIG. 2 shows the motor vehicle door lock shown in FIGS. 1A and 1B in standard operation and FIG. 3 shows a perspective detailed view onto the ratchet lever of the motor vehicle door latch in the event of a crash.

FIGS. 2 and 3 show that the ratchet lever 8 contains an indicated spring 13, 14. The spring 13, 14 is actually a leg spring with two legs 13, 14, although the invention is not restricted to this. One leg 13 of the spring 13, 14 is fixed on the ratchet lever 8, whilst the actuation lever 4 rests against the other leg 14 of the spring 13, 14. The actuation lever 4 actually contains a guide arm 15, engaging in a guide recess 16 on the ratchet lever 8 with a not expressly shown journal. As a result, the journal can interact with the leg 14 of the spring 13, 14.

It is apparent that the ratchet lever 8 is designed as a rectangular lever with side walls 17, eccentrically mounted on the axis 9. This means that the ratchet lever 8 has a spatial extension. The side walls 17 extending downwards from the edge of the rectangular lever or ratchet lever 8 in the direction of the frame box 5 consequently define a space in which to accommodate the spring 13, 14 arranged thereon. Also the journal of the actuation levers 4 connected to the guide arm 15, extends into this space through a guide recess 16. As a result, the respective journal can interact with the leg 14 of the spring 13, 14 as explained in more detail below In normal operation, the respective spring 13, 14 is actually acted upon by the actuation lever 4 in order to deflect the ratchet lever 8. This is apparent when comparing FIG. 1A, 1B with FIG. 2. FIG. 2 shows this normal operation, associated with the actuation lever 4 being pivoted around its axis 6 in clockwise direction and as a result, the arm 15 on the actuation lever 4 acting on the leg 14 of the spring 13, 14 via the journal. As the other leg 13 of the spring 13, 14 is securely connected to the ratchet lever 8, the ratchet lever 8 is pivoted around its axis 9 during this process. This occurs during every planned opening operation of the locking mechanism 1, 2, 3 in normal operation so that during every opening operation, the ratchet lever 8 is pivoted around its axis 9. This reliably prevents any sticking, corrosion, etc. of the ratchet lever 8.

In, however, the event of the already described increased retarding forces F of a given magnitude and direction during a crash, the ratchet lever 8 remains in its position as shown in FIG. 1A. The actuation lever or the triggering lever 4 is, however, pivoted in clockwise direction around its axis 6 by the occurring retarding forces F, as shown in FIG. 3. The pivoting movement of the actuation lever or of the triggering lever 4 is stopped as soon as the actuation lever 4 moves against the stop 12 of the stationary ratchet lever 8. A prior (small) pivoting movement of the actuation lever 4 around its axis 6 causes the leg 14 of the spring 13, 14 to be slightly pivoted, so that the spring 13, 14 is thus compressed by the actuation lever 4.

In order to realize the described eccentric bearing of the ratchet lever 8 in detail and to ensure that the respective centre of gravity S is arranged in the axial elongation of the axis 9 above the respective axis 9 of the ratchet lever 8, the ratchet lever 8 typically contains an extension 18, particularly apparent from FIG. 3. As a result of this extension 18, the mass distribution of the ratchet lever 8 is moved into the direction of the areas above axis 9 so that as a result, the centre of gravity S assumes the specified position above the axis 9.

FIG. 3 finally only indicates a stop 19 formed on the frame box 5. The stop 19 in or on the frame box 5 or in a housing, is assigned to the ratchet lever 8. The stop 19 ensures that in case of applied retarding forces F, the ratchet lever 8 is blocked in the opposite direction shown in FIG. 3. Such retarding forces F occur in the shown example not when the side door associated with the shown motor vehicle door latch but the opposite side door is subjected to a side impact. The stop 19 is in any case arranged and aligned in such a way that any pivoting movements of the ratchet lever 8 are not impeded during normal operation, as shown in FIG. 2 and that only the ratchet lever 8 is blocked in case of said retarding forces F in the direction opposite to that shown in FIG. 3.

The invention claimed is:

1. A motor vehicle door latch comprising:

a locking mechanism, an actuation lever for triggering the locking mechanisms, wherein, when the motor vehicle door latch is subjected to an accident ("crash"), the actuation lever generates a first torque, and a ratchet lever pivotable around and mounted on an axis, wherein a center of mass of the ratchet lever is offset from an axis of rotation of the ratchet lever, wherein, when the ratchet lever is subject to the accident, the ratchet lever generates a counter torque that counters the first torque generated by the actuation lever which blocks movement the actuation lever as a result of the accident, wherein, when the motor vehicle door latch is subjected to the accident, both actuation lever and the ratchet lever rotate in the same direction.

2. The motor vehicle door latch according to claim 1, wherein the ratchet lever has a centre of gravity positioned above or below the axis.

3. The motor vehicle door latch according to claim 2, wherein the centre of gravity is arranged in axial elongation above or below the axis of the ratchet lever.

4. The motor vehicle door latch according to claim 3, wherein the ratchet lever contains a connected spring acting on the actuation lever in normal operation which biases the ratchet lever and which is compressed by the actuation lever in the event of the accident.

5. The motor vehicle door latch according to claim 4, wherein the ratchet lever contains a first stop against which the actuation lever moves in the event of the accident and is blocked as a result.

6. The motor vehicle door latch according to claim 5, wherein the ratchet lever is configured as a rectangular shaped lever, mounted eccentrically on the axis and containing side walls.

7. The motor vehicle door latch according to claim 6, wherein the ratchet lever is axially elongated in the direction of the locking mechanism.

8. The motor vehicle door latch according to claim 1, wherein the ratchet lever contains a connected spring acting on the actuation lever in normal operation which biases the ratchet lever and which is compressed by the actuation lever in the event of the accident.

9. The motor vehicle door latch according to claim 1, wherein the ratchet lever contains a first stop against which the actuation lever moves in the event of a crash and is blocked as a result.

10. The motor vehicle door latch according to claim 1, wherein the ratchet lever is configured as a rectangular shaped lever, mounted eccentrically on the axis and containing side walls.

11. The motor vehicle door latch according to claim 1, wherein the ratchet lever is axially elongated in the direction of the locking mechanism.

12. The motor vehicle door latch according to claim 1, wherein the actuation lever actuates a pawl.

13. The motor vehicle door latch according to claim 1, further comprising a housing and a second stop in the housing which blocks movement of the ratchet lever in a direction opposite the counter torque.

14. The motor vehicle door latch according to claim 1, further comprising a housing and a second stop in the housing which blocks movement of the ratchet lever in a direction opposite the counter torque.

15. The motor vehicle door latch according to claim 1, wherein the ratchet lever abuts the actuation lever during normal operation.

16. The motor vehicle door latch according to claim 1, wherein the actuation lever is movable relative to the axis of the ratchet lever.

17. The motor vehicle door latch according to claim 1, wherein the actuation lever and the ratchet lever together define a contact area between the actuation lever and the ratchet lever so that rotation of the ratchet lever when subjected to the accident opposes rotation of the actuation lever when subjected to the accident.

18. The motor vehicle door latch according to claim 1, wherein the locking mechanism comprises a latch, a pawl and a blocking lever.

* * * * *